US008035465B2

(12) United States Patent
Goebel et al.

(10) Patent No.: US 8,035,465 B2
(45) Date of Patent: Oct. 11, 2011

(54) CAVITY RESONATOR, USE OF A CAVITY RESONATOR AND OSCILLATOR CIRCUIT

(75) Inventors: Uhland Goebel, Wila (CH); Jan Hesselbarth, Sennhof (CH); Peter Nuechter, Stein (CH); Daniel Stanelli, Wattwil (CH)

(73) Assignee: Huber & Suhner AG, Pfaeffikon (CH)

( * ) Notice: Subject to any disclaimer, the term of this patent is extended or adjusted under 35 U.S.C. 154(b) by 676 days.

(21) Appl. No.: 11/569,879

(22) PCT Filed: Jun. 1, 2005

(86) PCT No.: PCT/EP2005/005900
§ 371 (c)(1),
(2), (4) Date: Jun. 8, 2009

(87) PCT Pub. No.: WO2005/119833
PCT Pub. Date: Dec. 15, 2005

(65) Prior Publication Data

US 2009/0278631 A1 Nov. 12, 2009

(30) Foreign Application Priority Data

Jun. 3, 2004 (EP) ..... 04013104

(51) Int. Cl.
*H01P 7/06* (2006.01)

(52) U.S. Cl. ..... 333/229; 333/234

(58) Field of Classification Search ..... 333/227, 333/229, 232, 234, 208
See application file for complete search history.

(56) References Cited

U.S. PATENT DOCUMENTS

| | | | | |
|---|---|---|---|---|
| 2,507,426 | A * | 5/1950 | Turney | 333/229 |
| 2,528,387 | A | 10/1950 | Niessen | |
| 3,202,944 | A | 8/1965 | Grande | |
| 4,488,132 | A * | 12/1984 | Collins et al. | 333/229 |
| 4,706,053 | A | 11/1987 | Giavarini | |
| 5,309,129 | A * | 5/1994 | Arnold et al. | 333/229 |
| 5,374,911 | A * | 12/1994 | Kich et al. | 333/209 |
| 5,867,077 | A | 2/1999 | Lundquist | |
| 6,356,172 | B1 | 3/2002 | Koivisto et al. | |
| 6,362,706 | B1 * | 3/2002 | Song et al. | 333/219 |
| 6,433,656 | B1 | 8/2002 | Wolk et al. | |
| 6,529,104 | B1 | 3/2003 | Small et al. | |

FOREIGN PATENT DOCUMENTS

| | | |
|---|---|---|
| EP | 1 056 151 | 11/2000 |
| JP | 52 075154 | 6/1977 |

OTHER PUBLICATIONS

Song et al., Phase Noise Enhancement of the GaAs High Electron Mobility Transistors Using Micromachined Cavity Resonators at Ka-band, Jpn. J. Appl. Phys., vol. 38 (1999), p. 601-2.
Jpn. J. Appl. Phys., vol. 38 (1999), pp. 601-602.

* cited by examiner

*Primary Examiner* — Seungsook Ham
(74) *Attorney, Agent, or Firm* — Moetteli & Associes SaRL

(57) ABSTRACT

A cavity resonator having temperature compensation which comprises a pot and a cover, which together enclose a cavity resonance volume. The pot comprises a first material, which has a first temperature expansion coefficient and the cover comprises a second material, which has a second temperature expansion coefficient. The second temperature expansion coefficient is greater than the first temperature expansion coefficient, and an expansion of the pot and a deformation of the cover results upon a temperature increase, which each independently and also together cause an enlargement of the cavity resonance volume. Simultaneously, the resonance frequency remains essentially constant.

23 Claims, 4 Drawing Sheets

- Prior art-

- Prior art-

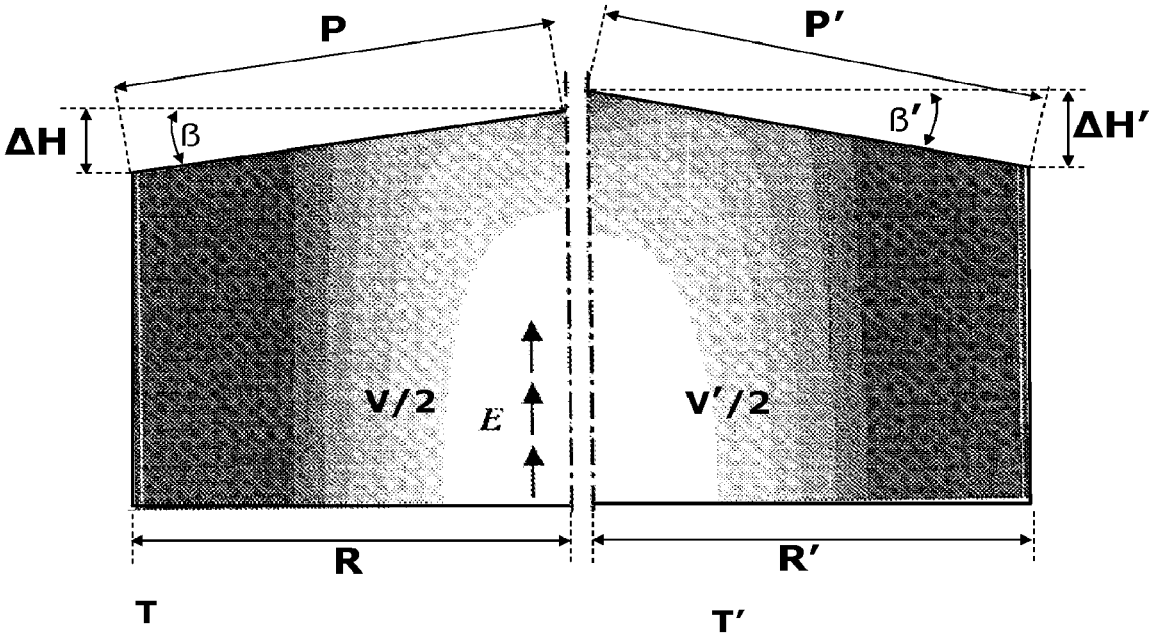
Fig. 3A
Fig. 3B
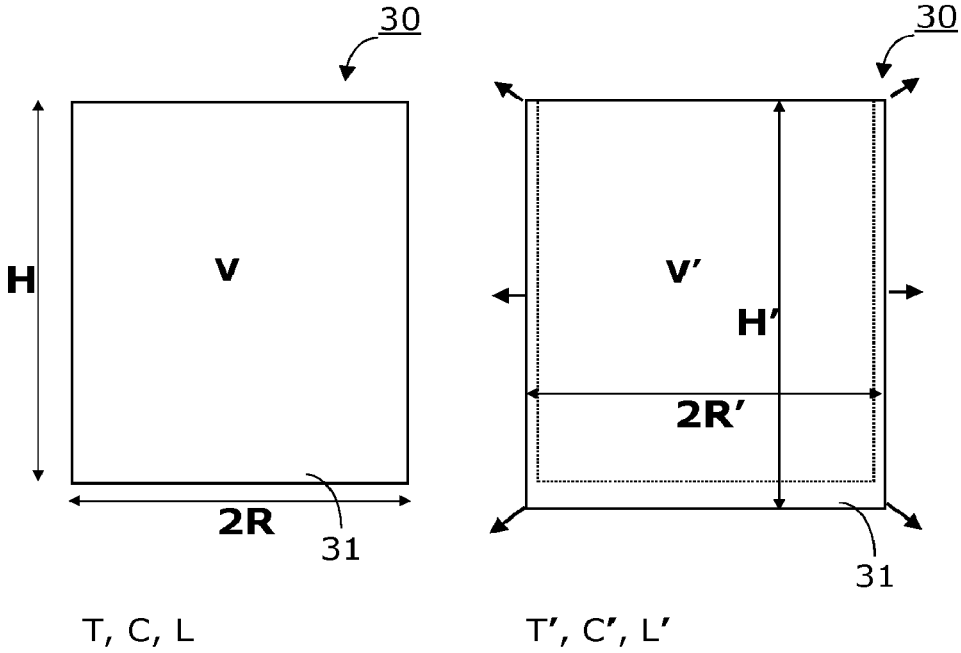
Fig. 4A
- Prior art-
Fig. 4B
- Prior art-

CAVITY RESONATOR, USE OF A CAVITY RESONATOR AND OSCILLATOR CIRCUIT

CROSS REFERENCE TO RELATED APPLICATIONS

The application is the National Stage of International Application no. PCT/EP2005/005900 which claims the benefit under 35 U.S.C. §119(e) of European Patent Application 04013104.7, filed Jun. 3, 2004.

BACKGROUND OF THE INVENTION

The present invention relates to cavity resonators and particularly their use in oscillator circuits.

Resonators are important components, which may be used in greatly varying applications. Thus, for example, microwave systems require high-quality resonators, which are used in filters and oscillator circuits. A choice must be made between cavity resonators and dielectric resonators, the size, the weight, the costs, and other aspects being able to play a role.

Cavity resonators in the various known embodiments are subject to a change of the resonance frequency in the event of temperature change, which is undesirable for most applications. A temperature change may result due to a change of the ambient temperature, due to a temperature change in an integrated oscillator circuit, or due to losses which occur in the resonant cavity. A change of the dimensions of the resonator results due to a temperature change, which results in the cited change of the resonance frequency.

There are various approaches for reducing the temperature influence on resonators. For example, it is possible to reduce the resonance frequency change caused by a temperature change by inserting a dielectric part into the cavity, the dielectric part having to have a suitable temperature coefficient of the dielectric permittivity.

Another possibility is to construct a cavity from various materials having different temperature expansion coefficients. This possibility is well-known and is used for "coaxial reentrant cavity" resonators. An example of such a resonator is described, for example, in Japanese Patent JP 52075154, which was published on Jun. 23, 1977. FIGS. 1A and 1B show a resonator 10 according to this Japanese patent in a greatly simplified illustration. As may be seen from FIGS. 1A and 1B, there is a rod 12, which penetrates coaxially into a cavity 11 of the resonator 10. A state having lower temperature T is shown in FIG. 1A. If the temperature is increased to T', the cavity 11 expands, as indicated by arrows around the circumference in FIG. 1B. The rod 12 becomes longer in the event of a temperature increase. If the materials of the cavity 11 in the rod 12 are selected so that the rod 12 experiences a smaller expansion, the capacitive gap (area 13) between the lower rod end and the lower wall of the cavity 11 becomes larger. This change of the capacitive gap (reduction of the capacitive load of the resonator in the event of a temperature increase) in the area 13 results in the resonator frequency of the resonator 10 remaining relatively constant in a specific temperature range. A disadvantage of such a reentrant cavity resonator 10 is the relatively poor quality factor Q. Especially at high frequencies above 10 GHz, the quality factor Q worsens noticeably because of the high field concentration in the capacitive gap and its immediate surroundings.

There are other resonators which are equipped with means for compensating for the temperature influence. These types of resonators are also referred to as "clamped cavity" resonators. An example of such a resonator may be inferred from U.S. Pat. No. 2,528,387. The cavity of the resonator is designed according to this approach in such a way that the geometric changes which would normally result due to a temperature change are locally restricted or even suppressed. This may be performed by a suitable selection of materials and measures which ensure that the volume of the resonator is kept constant by compensating for an enlargement of the cross-section through a reduction of the length. Further similar examples may be inferred from U.S. Pat. No. 4,706,053 and U.S. Pat. No. 6,529,104, which also each suggest means for keeping the volume of a resonator nearly constant in the event of a temperature change.

Other resonators are in turn manufactured from Invar® or similar materials, which have a low temperature expansion coefficient. However, Invar is expensive and difficult to process.

SUMMARY OF THE INVENTION

Proceeding from the prior art cited at the beginning, the object presents itself of providing a resonator which prevents or reduces a change of the resonance frequency in the event of a temperature change. In addition, the present invention is directed to providing a resonator which is cost-effective.

It is a further object of the present invention to provide various possible uses for such a novel resonator having temperature compensation and corresponding oscillator circuits.

According to the present invention, a cavity resonator is provided whose volume increases in the event of a temperature increase and decreases in the event of a temperature reduction, without the resonance frequency experiencing a strong change at the same time. To achieve this, the cavity resonator comprises a pot and at least one cover, which are manufactured from materials having different temperature expansion coefficients, the at least one cover having a greater temperature expansion coefficient than the pot. Although both parts of the cavity resonator, namely the pot and the cover, contribute to enlarging the cavity volume in the event of a temperature increase, the resonance frequency may be kept essentially constant with suitable selection of the waveguide modes, since the cover curves outward due to suitable shaping and thus forms a field-poor zone in the area of the cover.

To fulfill the object stated at beginning, a cavity resonator having the features according to claim 1, the use of a cavity resonator having the features according to claim 16, and an oscillator circuit having the features according to claim 17 are provided.

Further embodiments of the cavity resonator according to the present invention may be inferred from dependent claims 2 through 15 and further embodiments according to the present invention of the oscillator circuit may be inferred from dependent claims 18 through 19.

BRIEF DESCRIPTION OF THE DRAWINGS

The present invention is described in greater detail in the following on the basis of exemplary embodiments illustrated in the drawing. Which show FIGS. 1A, 1B a schematic sectional illustration of a conventional reentrant cavity resonator, FIG. 1A showing the state at a temperature T and FIG. 1B at a higher temperature T';

FIG. 3A, 3B a schematic illustration of the intensity distribution of the electrical field strength in a cavity resonator according to the present invention, FIG. 3A showing the state at a temperature T and FIG. 3B at a higher temperature T';

FIG. 4A, 4B a schematic sectional illustration of a conventional cavity resonator, FIG. 4A showing the state at a temperature T and FIG. 4B at a higher temperature T';

DETAILED DESCRIPTION

In the following, terms which arise multiple times in the description and the claims are explained and defined.

The cavity resonator is a component which oscillates in a predefined wavelength range, for example, in the microwave range. As the term "cavity resonator" indicates, such a resonator has a cavity, whose walls form a body which essentially encloses the cavity. This body is referred to herein as a pot independently of its actual shape. Such a cavity typically has the shape of a cylinder, a prism, or a sphere, for example, and the walls are made of metal or provided with a metal layer, the metal or the metal layer having a very high electrical conductivity. Copper, a copper alloy (such as CuW), gold, or silver, or a superconducting material are especially suitable, to name a few examples.

In contrast to the previously known approaches, according to the present invention a cavity resonator is provided whose volume increases in the event of a temperature increase, and decreases in the event of a temperature reduction, without the resonance frequency experiencing a strong change at the same time. In the following, exemplary embodiments are described and the mode of operation is explained on the basis of the temperature embodiments.

Figure 2:
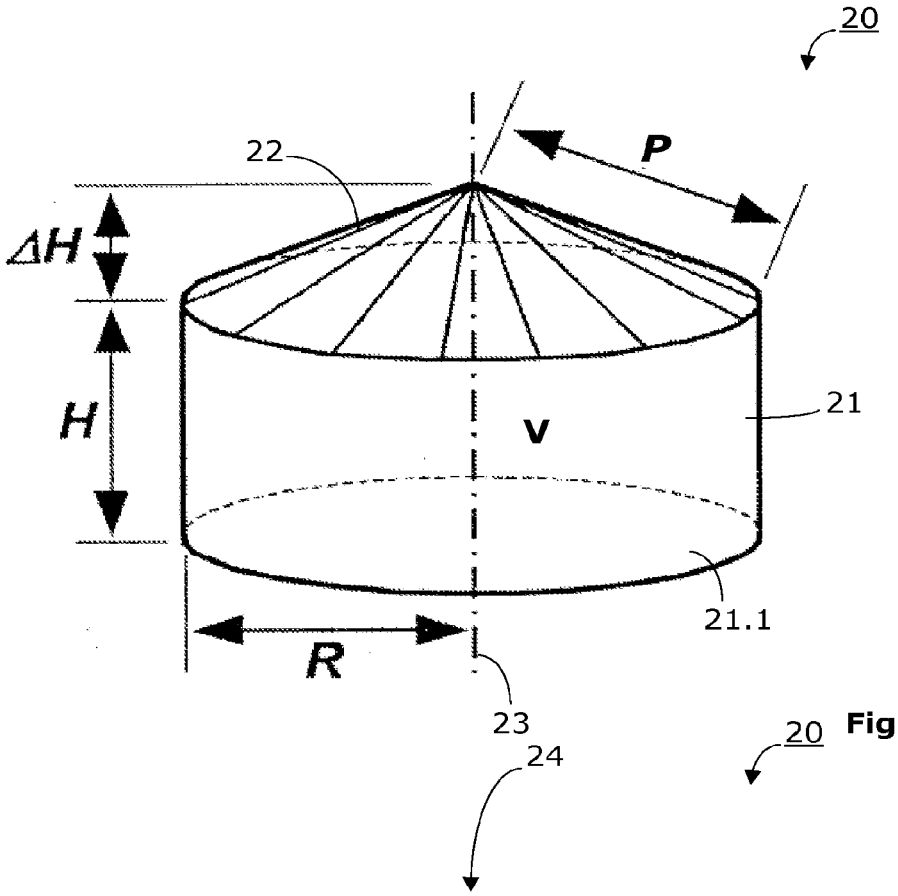
FIG. 2 a schematic view of a cavity resonator in a first embodiment of the present invention.

A first embodiment of the present invention is shown in FIG. 2. A schematic view of a cavity resonator 20 is shown. The cavity resonator 20 has a cylindrical pot 21 having a floor 21.1 and a cover 22, which together enclose a cavity resonance volume V. The cavity resonator 20 is distinguished in that the pot 21 comprises a first (metallic) material, which has a first temperature expansion coefficient $\alpha 1$. The cover 22, in contrast, comprises a second (metallic) material which has a second temperature expansion coefficient $\alpha 2$. According to the present invention, the second temperature expansion coefficient $\alpha 2$ is greater than the first temperature expansion coefficient $\alpha 1$, i.e., $\alpha 2 > \alpha 1$. This has the result that, in contrast to the prior art, in the event of a temperature increase, expansion of the pot 21 and deformation of the cover 22 result, which together cause of an enlargement of the cavity resonance volume V when the cover 22 bulges outward (the outward bulge will strengthen under the conditions described in the event of a temperature increase).

In the exemplary embodiment shown, the pot 21 has a cylindrical shape having a radius R and a (resonator) height H. A cupola-shaped element, which has a height ΔH and a length P, is used as the cover 22. The pot 21 and the cover 22 are situated rotationally symmetric around the axis 23. The rotational symmetry is advantageous for the production process (turning on a lathe), but is not essential for the principal mode of operation of the compensation according to the present invention.

The resonance frequency $f_{R,\,TM010}$ of the $TM_{010}$ mode in a cavity resonator having a purely cylindrical cavity is not a function of the height H of the pot and is given by the following equation:

$$f_{R,TM010} = 0.38274 \cdot \frac{c}{R'}$$

c being the speed of light and R being the radius of the pot. For the present case ($0<\Delta H<<H$), the field distribution is similar to that of the TM010 mode. The above formula applies approximately, so that it may be used as a good first estimation in the design process. The fact that the resonance frequency is independent of H also applies only for $\Delta H=0$, otherwise there is a slight dependence (higher order effect) of the resonance frequency on the height H. For this mode similar to $TM_{010}$, if the pot 21 was manufactured from a metal having a temperature expansion coefficient $\alpha 1$, the temperature coefficient of the resonance frequency is $-\alpha 1$. According to the present invention, a cover 22 is provided whose temperature expansion coefficient $\alpha 2$ is greater than the first temperature expansion coefficient $\alpha 1$ of the pot 21. This results in the cover bulging outward in the event of a temperature increase. If the cover 22 is cupola-shaped, as shown in FIG. 2, the "cupola" becomes more pointed and a total volume of the cavity V' which is greater than the original volume V results (both the volume of the pot and also that of the cupola increasing).

In addition to the enlargement of the volume from V to V', a change of the geometric relationships in the area of the cover 22 also results. The influence of the volume and geometry change on the electrical properties of the resonator 20 is explained in the following on the basis of FIGS. 3A and 3B. The distribution of the intensity of the electrical field strength E at a first temperature T is shown in FIG. 3A. The cover 22 has a length P and a height ΔH as in FIG. 2. If the temperature is increased from T to T', the situation indicated in FIG. 3B results, in which the cover 22 has bulged somewhat upward. The length P becomes the length P' and the angle of inclination β becomes β' with $P<P'$, $\Delta H<\Delta H'$, and $\beta<\beta'$. As an approximation, P increases with the material expansion coefficient $\alpha 2$, while ΔH increases much more strongly because of the lever effect. It may be seen in FIG. 3B that the electrical field strength is reduced in the area of the cover 22 which is bulged further outward. A field-poor zone 24 arises in the example shown in the area of the cover tip, since the field distribution travels outward along the cover 22. This reduction of the electrical field strength corresponds to a reduction of the capacitive load of the resonator 20, which in turn results in an increase of the resonance frequency $f_R$. In the example shown in FIGS. 3A and 3B, the ratio P/R=1.01 and the ratio P'/R'=1.02 in FIG. 3B. Even small geometric changes in the area of the cover of this type are sufficient to reduce the influence of the temperature on the resonance frequency, or even to reverse it (overcompensation) if needed.

To be able to exploit this effect of the local field strength production, as already described, the temperature expansion coefficient $\alpha 2$ of the cover 22 must be greater than the temperature expansion coefficient $\alpha 1$ of the pot 21. This results in the radius R of the pot 21 becoming larger and the cupola-shaped cover 22 bulging further outward when the temperature is increased from T to T'. A reduction of the resonance frequency $f_R$ results due to the increase of the radius R and an increase of the resonance frequency $f_R$ results due to the more strongly bulging cover.

An additional volume is formed according to the present invention by the deformation of the cover in the event of temperature increase in the various embodiments, which contributes to the total volume of the cavity enlarging. Contrary to the expectation of those of average skill in the art, this enlargement of the volume does not result in a reduction of the resonance frequency, however, since a geometric change in the area of the cover results and a field-poor zone is formed there, as described.

The principle of the present invention is described in the following on the basis of FIGS. 4A-4D, the figures and the following description being a strongly simplified representation of the actual state of affairs. In this simplified representation, it is assumed that a cavity resonator may be viewed as a combination of a capacitance C and an inductance L, as may be inferred from the following equation, $f_R$ being the resonance frequency:

$$f_R = \frac{1}{2\pi\sqrt{L \cdot C}}.$$

FIG. 4A shows a conventional cavity resonator 30 having a pot 31, which is closed in all directions. This cavity resonator 30 has a volume V, a capacitance C, and an inductance L at the temperature T. If the temperature is now increased from T to T', the state shown in FIG. 4B results. If the height H of the resonator pot 31 changed, the resonance frequency $f_R$ would remain constant because of the properties of the TM 010 mode, i.e., $f_R = f'_R$, because the capacitance is reduced, i.e., $C' < C$, and the inductance increases, i.e., $L' > L$. However, the radius R of the pot 31 also increases upon the temperature increase, which both results in an enlargement of the inductance, i.e., $L' > L$, and also an enlargement of the capacitance, i.e., $C' > C$. The volume V has enlarged to V' due to the change of the height H and the radius R, the capacitance C' has changed, i.e., $C' \neq C$, and the inductance has enlarged, i.e., $L' > L$, as already noted. Since the product of inductance and capacitance remains constant in the case of a high change, but the radius R enlarges in case of an enlargement ($L'C' > LC$), an undesired reduction of the resonance frequency $f_R$ results. A temperature compensation may not be achieved in this way.

Figure 4C:
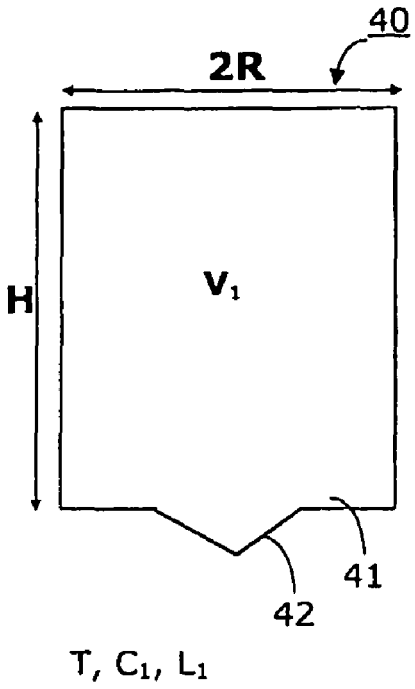
FIG. 4C, 4D a schematic sectional illustration of a cavity resonator according to the present invention, FIG. 4C showing the state at a temperature T and FIG. 4D at a higher temperature T'.
Figure 4D:
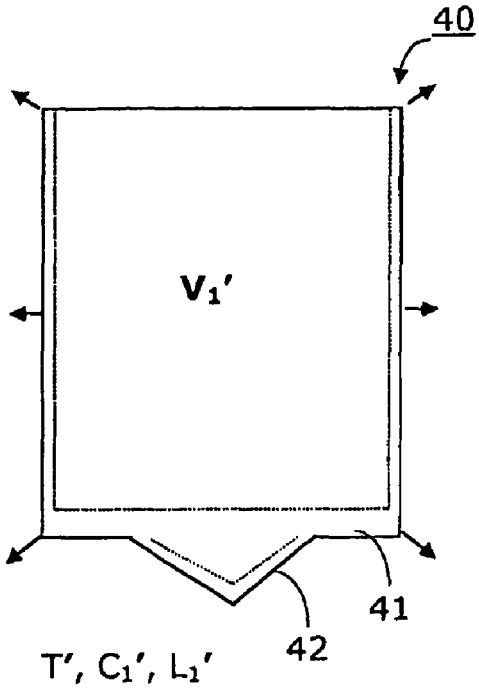

The behavior of a resonator 40 according to the present invention is shown in FIGS. 4C and 4D. The resonator 40 has a cover 42 having a conical area, which bulges downward in the figures shown. This cavity resonator 40 has a volume $V_1$, a capacitance $C_1$ and an inductance $L_1$ at the temperature T. The inductance $L_1$ is approximately equally as large as the inductance L in FIG. 4A, since adding a bulging cover does not cause any significant H field change and therefore no significant inductance change. The capacitance $C_1$, however, is smaller than the capacitance C, since the E field is reduced by the pointed implementation of the cover 42.

If the temperature is increased from T to T', the state shown in FIG. 4D results, the dimension changes of the resonator 40 intentionally having been shown exaggerated. The volume $V_1$ has enlarged to $V_1'$, the capacitance $C_1'$ has become smaller, i.e., $C_1' < C_1$, and the inductance has enlarged, i.e., $L_1' > L_1$. It is also true that $L_1'$ is approximately as large as L' in resonator 30 (see FIG. 4B). Because the capacitance has been reduced and the inductance has enlarged, the temperature dependence of the resonance frequency may be influenced as desired. It is important that the temperature-related changes of L and C may be influenced separately from one another by the construction of the resonator 30.

A cavity resonator according to the present invention may be dimensioned as follows. In a first step, the material selection may be made and a resonance frequency $f_R$ may be predefined. The pot may comprise CuW and the cover may comprise CuBe, for example. The dimensions of the pot (H and R), and the dimensions of the cover (P and ΔH) are then fixed. The resonance frequency $f_R$ may then be calculated using a commercially available simulation program, which solves the present eigenvalue problem for the Maxwell differential equations for the given geometry. The rotational symmetry of the geometrical configuration may be exploited, which allows precise simulation results to be obtained in a short time. If the calculated value of the resonance frequency $f_R$ does not correspond to the preset, the starting variables (e.g., H, R, and ΔH) may be modified to repeat the calculation. In a following step, the influence of a temperature change (elevation or reduction of the temperature) on the shape of the pot and the cover may be ascertained. This is performed using commercially available simulation programs for this mechanical problem or experimentally. In addition, the mechanical tensions in the pot and/or the cover may be calculated/simulated. If the mechanical tensions are to be too large, the starting variables (e.g., H, R, and ΔH) may be modified again to repeat the calculation. The dependence of the resonance frequency $f_R$ on the temperature may be calculated/simulated. Presets for the mechanical tolerances may be incorporated in this calculation. If the dependence of the resonance frequency $f_R$ is in a predefined range, the calculations may be ended, otherwise, the starting variables (e.g., H, R, and ΔH) may be modified again to repeat the calculation.

With suitable selection of the geometry and the materials of the pot and the cover of the various embodiments of the present invention, reduction of the temperature dependence of the resonance frequency $f_R$ or complete compensation or even reversal of the temperature dependence (overcompensation) results at least in a predefined temperature range (e.g., operating temperature±50 K).

The present invention is particularly suitable for use in circuits which are designed for processing high-power signals for broadband communication.

A resonator according to the present invention may be a component of a filter circuit, which comprises an oscillator having the resonator in the feedback branch. Only one frequency is transmitted by this type of configuration.

According to the present invention, the circuit may be constructed on a ceramic substrate, such as a multilayer LTCC (low-temperature cofired ceramics) substrate. Such a substrate may be seated on a base plate which in turn carries the resonator according to the present invention. The ceramic substrate and the base plate may have a compatible temperature expansion coefficient (i.e., only slightly varying), to be able to form a stable bond.

Figure 5:
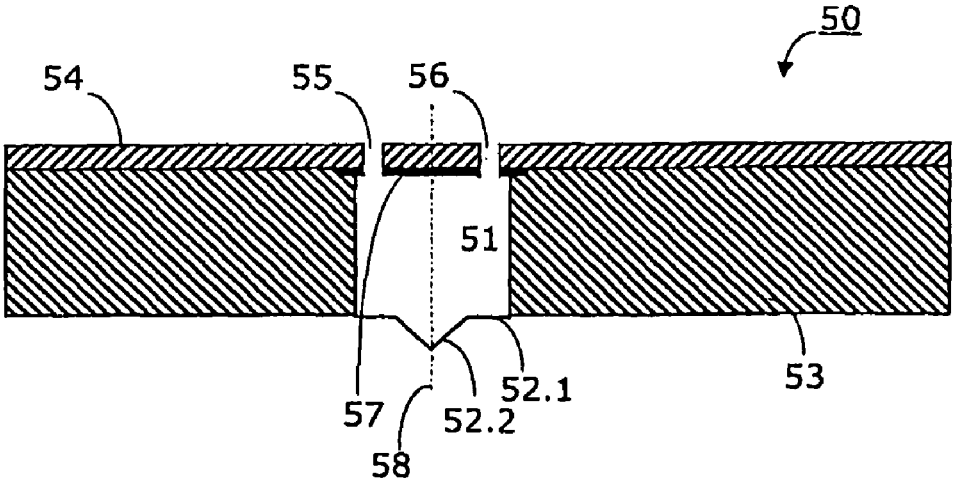
FIG. 5 a schematic sectional illustration of a circuit having a cavity resonator in a further embodiment of the present invention.

An embodiment of a circuit 50 in which the pot 51 of the resonator is implemented in a base plate 53 of the circuit, as shown in FIG. 5, is preferred. The base plate 53 is bonded to a substrate 54 and may be used as a heat sink, e.g., as a heat sink for electronic components which are mounted on the opposite side of the substrate 54. Elements of the circuit 50 are integrated in the substrate 54 and/or on the substrate 54 (these elements are not shown). The pot 51 is cylindrical in the example shown. A conductive surface 57 is provided in the area of the pot floor, which is indicated in FIG. 5 as a thick metallic layer. A cover 52 is provided at the diametrically opposite end of the pot 51. This cover 52 comprises an outer annular area 52.1, which runs essentially parallel to the conductive surface 57. The cover 52.2 is bulged downward conically in the area around the cylindrical axis 58. A coupling hole 55 for coupling in an electromagnetic wave and a coupling hole 56 for decoupling the wave are provided. Alternatively, this coupling and decoupling may also be performed through the same coupling hole. Strip conductors are typically situated on the substrate 54 to conduct the wave to the coupling point 55 and to receive it and relay it again on the other side 56. The strip conductors are not shown in FIG. 5.

The first material is preferably selected in a circuit according to the present invention so that the temperature expansion coefficient $\alpha 1$ of the base plate is adjusted to the temperature expansion coefficient $\alpha 3$ of the substrate.

Figure 6:
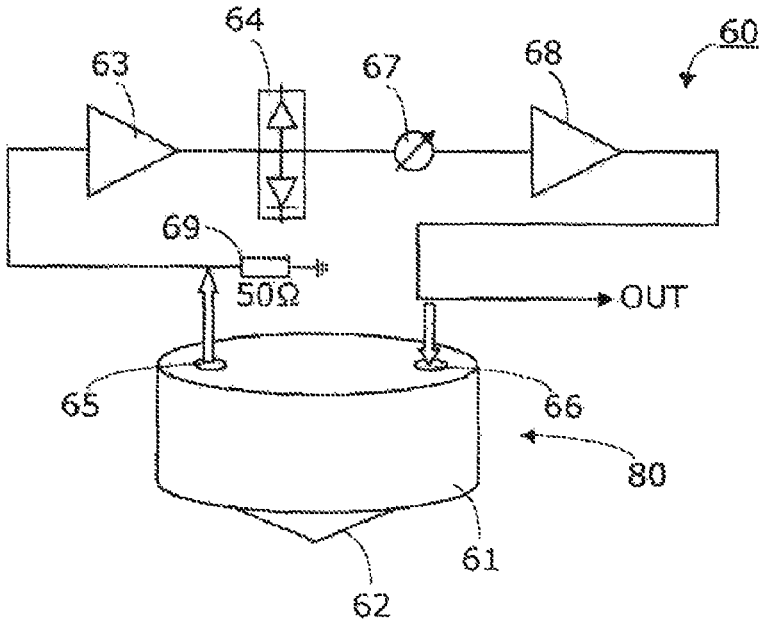
FIG. 6 a schematic block diagram of a further circuit having a cavity resonator in a further embodiment of the present invention.

A further circuit 60 according to the present invention is shown in FIG. 6 in the form of a block diagram. This is an oscillator circuit 60 having a resonator 80 according to the present invention, which has a pot 61 and a cover 62. A coupling point 66 and a decoupling point 65 are provided in the floor of the pot 61. The decoupled signal is coupled into a line which leads to an amplifier (low noise amplifier) 63, where the signal is amplified. An optional damping element 64 having two PIN diodes is provided in the embodiment shown, which limits the output through "clipping". A phase setting element 67 may be provided to be able to statically set the phase position. The phase setting element 67 is also optional. A further amplifier 68 is provided at the output to be able to generate sufficiently large output signal power. This second amplifier 68 is typically directed to good dissipation of the waste heat, which may be ensured by the present structure (having a massive floor plate 53 which conducts heat well, FIG. 5). The output (OUT) of the oscillator circuit lies at the output side of the amplifier 68. Output is taken from the circuit 60 at this output. A small part of the output is conducted via the coupling point 66 into the resonator 80. The resonator 80 thus lies in the feedback path of the circuit 60.

To be able to compensate for temperature shifts of the oscillation frequency of the oscillator circuit 60 which may be caused by components of the circuit 60, the temperature compensation of the resonator 80 may be designed so that the resonator 80 also displays undercompensation or overcompensation.

In the preferred embodiment, which is shown in FIG. 6, the circuit 60 comprises an electrical component 64 to limit the power. A stable oscillation state may thus be achieved. Output may be decoupled from the circuit 60 at a suitable point (identified by OUT), the decoupling being able to be performed capacitively, inductively, or directly. It is important that the total amplification in the circuit 60 is sufficient and the phase position corresponds so that the oscillation begins and the circuit 60 oscillates stably.

Figure 7:
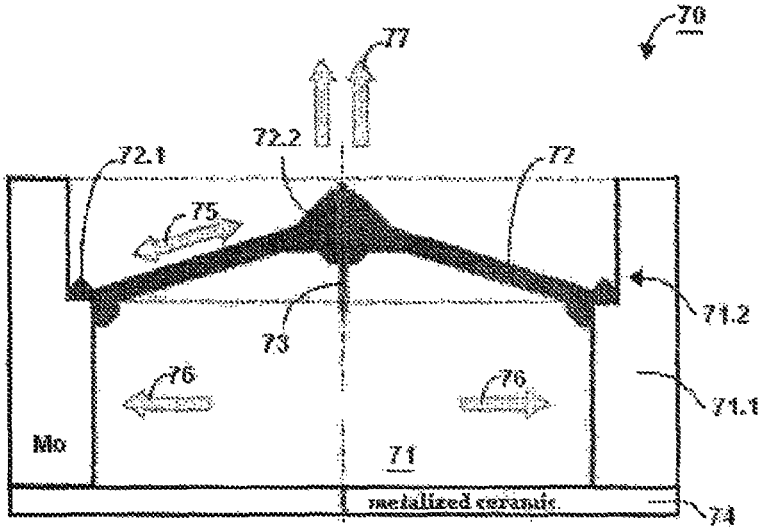
FIG. 7 a schematic sectional illustration of a cavity resonator in a further embodiment of the present invention.

A further embodiment of a cavity resonator 70 according to the present invention is shown in FIG. 7. The resonator 70 has a cylindrical pot 71 and a cover 72, which are designed so that the temperature compensation according to the present invention is used. The walls 71.1 of the pot 71, the base plate 74 (for example, in the form of a ceramic plate which is metal coated on one side), and the cover 72 enclose a cavity resonance volume together. The pot 71 comprises a first (metallic or metal-coated) material, which has a first temperature expansion coefficient $\alpha 1$, which is preferably in the range between 4 ppm/K and 10 ppm/K. The cover 72 comprises a second (metallic or metal-coated) material, which has a second temperature expansion coefficient $\alpha 2$, which is preferably in the range between 10 ppm/K and 20 ppm/K. The second temperature expansion coefficient $\alpha 2$ is therefore greater than the first temperature expansion coefficient $\alpha 1$. In the event of a temperature increase, an expansion of the pot 71, as indicated by the outwardly pointing arrows 76, and a deformation of the cover 72, as indicated by the arrows 75 and 77, result. These two expansions/deformations cause, both together and also viewed individually, an enlargement of the cavity resonance volume, the resonance frequency remaining in a predefined (tolerance) range.

In the following, further exemplary statements on the resonator 70 are made. The radius R of the pot 71 is typically between 2.5 mm and 10 mm. In the exemplary embodiment shown, the radius is 4 mm. The height H is typically between 2 mm and 20 mm. In the exemplary embodiment shown, the total height is approximately 4 mm (total height=H+ΔH). The cover 72 may have a peripheral collar 72.1 to be able to connect the cover 72 to the wall 71.1 of the pot 71. For this purpose, the pot 71 may have a larger radius in the upper area than in the lower area. A peripheral step 71.2, on which the cover 72 may be placed, thus results. The cover 72 has a thickening 72.2 in the center in the exemplary embodiment shown. A through hole which runs axially is provided in the area of the thickening 72.2. A dielectric rod 73 may be inserted through this hole into the cavity of the resonator 70. Using this rod 73, which is optional, the resonance frequency may be adjusted within certain limits, since the rod 73 changes the effective permittivity depending on the position in the cavity.

The resonator pot may be bored, milled, turned, cast, deep drawn, or otherwise manufactured according to the present invention. The inner walls of the pot are preferably finish processed to produce a surface having low surface roughness. Rolling, grinding, polishing, and coating are especially suitable as finish processing.

An embodiment in which the walls of the pot have a low roughness and are preferably coated using gold and/or silver is especially advantageous.

In an especially advantageous embodiment, it is ensured by special measures that the cover and/or the pot are conductively connected to one another. This electrical connection may be provided on the entire circumference of the cover or on a significant part of the circumference. The cover is preferably electrically and mechanically connected to the pot by a soldered and/or welded connection.

A further embodiment is distinguished in that instead of the pot having only one cover, a pot (manufactured from a prismatic or round tube, for example) is used which has covers on both sides. In this case, both covers may contribute to the described functional principle for the compensation.

It is seen as an advantage of the present invention that if the $TM_{010}$ mode is used, the height H of the pot may be selected freely. The condition does not have to be fulfilled here, as in conventional waveguide resonators (which operate in the waveguide resonance mode), that the height of the resonator corresponds to half of the wavelength (or to an integral multiple thereof). In contrast, the electromagnetic field in the $TM_{010}$ mode and also in the resonator according to the present invention corresponds to that in a waveguide cross-section at the cutoff frequency. The resonance frequency is thus nearly independent of the height H of the resonator. As a result, an additional degree of freedom when fixing the dimensions of the resonator is obtained by the present invention. The (resonator) height H may be selected, for example, so that a large quality factor Q results. For example, a quality factor of 3000 may be achieved according to the present invention (at room temperature, $f_R$~30 GHz, and gold metal coating on the surface of pot and cover).

The cover according to the present invention is preferably shaped like a cupola, dome, or cone, and forms—viewed from the direction of the pot—a cavity. However, other shapes are also conceivable.

Figure 1A:
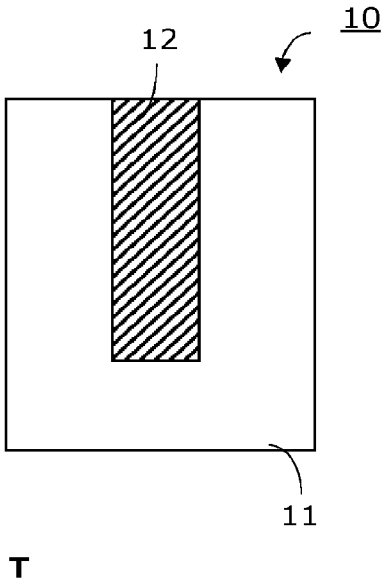
Figure 1B:
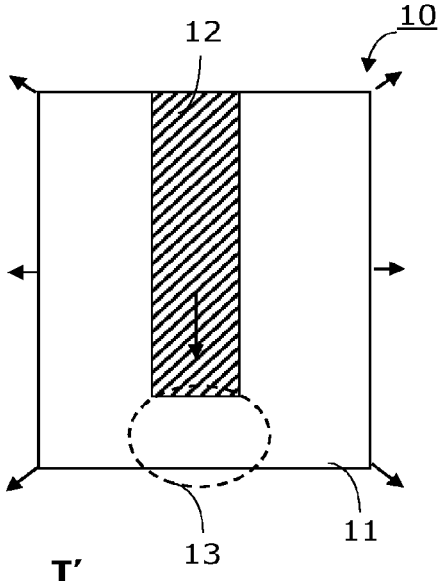

The present invention is viewed as a real alternative to the resonators which were identified at the beginning as "clamped cavity" resonators. The present invention is a real improvement of the reentrant approach, which was described in connection with FIGS. 1A and 1B. An advantage in relation to the reentrant resonators is the significantly higher quality. It is seen as an advantage in relation to "clamped cavity" resonators and also reentrant resonators that more degrees of freedom are available in the selection of materials and shape and that simpler mounting is possible. In addition, there is lower sensitivity in relation to manufacturing tolerances.

Depending on the embodiment of the present invention, a resonator may be implemented which has a dependence of the resonance frequency on the temperature in the range between −10 ppm/K and +10 ppm/K. The dependence of the resonance frequency $f_R$ may be fixed in a predefined scope depending on the application and this scope may be maintained as predefined by appropriate design of the resonator.

The compensation effect achievable by the present invention is quantitatively determined by the selection of the materials and by the geometry. A material is preferably used for the top which has an expansion coefficient $\alpha$1 between 4 ppm/K and 10 ppm/K (such as a copper-tungsten alloy, CuW, with $\alpha$1=6.1 ppm/K). In contrast, the cover comprises a material which preferably has an expansion coefficient $\alpha$2 between 10 ppm/K and 20 ppm/K (such as another copper alloy like copper-beryllium, CuBe, having $\alpha$2=17.0 ppm/K). Embodiments in which the second temperature expansion coefficient $\alpha$2 is between 1.1 and 5 times as large as the first temperature expansion coefficient at are especially advantageous.

The resonators according to the present invention have the advantage that their quality factor Q is not impaired by the temperature compensation measures, which is the case, for example, in the "reentrant resonators".

The present invention allows resonators to be provided which have a high quality factor Q and low losses. Resonators of this type are especially well suitable for oscillator circuits having low noise. In filter circuits (assembled from multiple resonators), high-quality resonators allow the implementation of filters having steep flanks, i.e., especially frequency-selective filters, and/or filters having especially low insertion damping in the transmission frequency range.

It is a further advantage of the present invention that the same action principle may also be applied to other resonance modes $TE_{m0n}$ in a rectangular cavity or $TM_{0n0}$ (with m, n>0 and integral) in a circular cavity. Many of these resonance modes result in larger, more mechanically complex (e.g., rectangular instead of circular) structures which are more sensitive to tolerances. However, the advantage, as described, is the ability to achieve higher quality (lower losses).

The invention claimed is:

1. Cavity resonator (20; 40; 80; 70) with temperature compensation which comprises a pot (21; 41; 51; 61; 71) and a cover (22; 42; 52.1, 52.2; 62; 72), which together enclose a cavity resonance volume (V), the cavity resonator having a characteristic resonance frequency in operation, which resonance frequency has a coefficient of temperature which is not equal to zero, wherein the pot (21; 41; 51; 61; 71) comprises a first material which has a first temperature expansion coefficient ($\alpha$1), the cover (22; 42; 52.1, 52.2; 62; 72) comprises a second material which has a second temperature expansion coefficient ($\alpha$2), the second temperature expansion coefficient ($\alpha$2) being greater than the first temperature expansion coefficient ($\alpha$1) and an expansion of the pot (21; 41; 51; 61; 71) and a deformation of the cover (22; 42; 52.1, 52.2; 62; 72) resulting upon a temperature increase which, together and also each individually, cause an enlargement of the cavity resonance volume (V), wherein further, the deformation comprises the cover bulging out due to the deformation thereof, resulting in an increase in the resonance frequency and an enlargement of the diameter of the pot due to the expansion of the pot, resulting in a reduction of the resonance frequency, the increase and the reduction of the resonance frequency thus essentially offsetting one another in order to ensure that the resonance frequency remains essentially stable in an operating temperature range.

2. Cavity resonator (20; 40; 80; 70) according to claim 1, wherein the resonance frequency ($f_R$) of at least one resonance mode remains stable.

3. Cavity resonator (20; 40; 80; 70) according to claim 1, wherein a local reduction of an electrical field strength ($\vec{E}$) in the cavity resonance volume results due to the deformation of the cover (22; 42; 52.1, 52.2; 62; 72).

4. Cavity resonator (20; 40; 80; 70) according to claim 1, wherein a reduction of a capacitive load of the cavity resonator (20; 40; 80; 70) results due to the deformation of the cover (22; 42; 52.1, 52.2; 62; 72).

5. Cavity resonator (20; 40; 80; 70) according to claim 1, wherein the cover (22; 42; 52.1, 52.2; 62; 72) has a cupola- or conelike shape and forms a cavity viewed from the direction of the pot (21; 41; 51; 61; 71).

6. Cavity resonator (20; 40; 80; 70) according to claim 5 wherein the cavity resonator (20; 40; 80; 70) is suitable for integration in a metallic base plate of a ceramic substrate (54; 74).

7. Cavity resonator (20; 40; 80; 70) according to claim 6, wherein the pot of the resonator is implemented in said base plate and the first material is selected so that the first temperature expansion coefficient ($\alpha$1) of the base plate is adjusted to the temperature expansion coefficient ($\alpha$3) of the substrate (54; 74).

8. Cavity resonator (20; 40; 80; 70) according to claim 1, wherein the cavity resonator (20; 40; 80; 70) has a quality factor (Q) which is essentially determined by the resonator height (H) of the pot (21; 41; 51; 61; 71).

9. Cavity resonator (20; 40; 80; 70) according to claim 1, wherein the pot (21; 41; 51; 61; 71) comprises a copper alloy and the cover comprises another copper alloy.

10. Cavity resonator (20; 40; 80; 70) according to claim 1, wherein the second temperature expansion coefficient ($\alpha$2) is between 1.1 and 5 times as large as the first temperature expansion coefficient ($\alpha$1).

11. Cavity resonator (20; 40; 80; 70) according to claim 1, wherein the pot (21; 41; 51; 61; 71) has a low roughness inside.

12. Cavity resonator (20; 40; 80; 70) according to claim 1, wherein means (73) are provided for influencing the resonance frequency.

13. Cavity resonator (20; 40; 80; 70) according to claim 1, wherein means (55, 56; 65, 66) are provided for coupling and decoupling an electromagnetic wave.

14. Use of a cavity resonator (20; 40; 80; 70) according to claim 1 in a microwave system (50; 60), the cavity resonator (20; 40; 80; 70) being part of an oscillator circuit.

15. Oscillator circuit (50; 60), wherein the cavity resonator (20; 40; 80; 70) according to claim 1 is part of the oscillator circuit (50; 60).

16. Oscillator circuit (50; 60) according to claim 15, wherein the oscillator circuit (50; 60) is integrated in or on a ceramic substrate (54; 74), preferably a LTCC multilayer ceramic.

17. Oscillator circuit (50; 60) according to claim 16, wherein a part of the oscillator circuit (50; 60) is situated on one side of the ceramic substrate (54; 74) and the cavity resonator (20; 40; 80; 70) is situated on another side of the ceramic substrate (54; 74).

18. Cavity resonator (20; 40; 80; 70) according to claim 6, wherein said metallic base plate is the base plate of an LTCC multilayer ceramic.

19. Cavity resonator according to claim 9, wherein the pot comprises a copper-tungsten alloy, and the cover comprises a copper-beryllium alloy.

20. Cavity resonator (20; 40; 80; 70) according to claim 1, further coated using gold and/or silver.

21. Cavity resonator (20; 40; 80; 70) according to claim 12, wherein said means for influencing resonance frequency protects partially into the cavity resonance volume and change the effective permittivity therein.

22. Cavity resonator (20; 40; 80; 70) according to claim 13, wherein one hole each is provided for coupling and decoupling.

23. Oscillator circuit (50; 60) according to claim 15, wherein the oscillator circuit (50; 60) is integrated in or on a LTCC multilayer ceramic substrate.

* * * * *